US012486610B2

(12) United States Patent
Yamashita et al.

(10) Patent No.: US 12,486,610 B2
(45) Date of Patent: Dec. 2, 2025

(54) LAUNDRY DRYING IMPLEMENT

(71) Applicant: MORITA ALUMINUM INDUSTRY, INC., Osaka (JP)

(72) Inventors: Kimiaki Yamashita, Osaka (JP); Tendo Kusunoki, Osaka (JP)

(73) Assignee: MORITA ALUMINUM INDUSTRY, INC., Osaka (JP)

( * ) Notice: Subject to any disclaimer, the term of this patent is extended or adjusted under 35 U.S.C. 154(b) by 258 days.

(21) Appl. No.: 18/268,789

(22) PCT Filed: Dec. 23, 2020

(86) PCT No.: PCT/JP2020/048237
§ 371 (c)(1),
(2) Date: Jun. 21, 2023

(87) PCT Pub. No.: WO2022/137398
PCT Pub. Date: Jun. 30, 2022

(65) Prior Publication Data
US 2024/0068150 A1 Feb. 29, 2024

(51) Int. Cl.
*D06F 53/04* (2006.01)
*D06F 53/02* (2006.01)

(52) U.S. Cl.
CPC ..... *D06F 53/04* (2013.01); *D06F 53/02* (2013.01)

(58) Field of Classification Search
CPC ..... D06F 53/02; D06F 53/04; D06F 53/045; B65H 75/30; B65H 75/38
See application file for complete search history.

(56) References Cited

U.S. PATENT DOCUMENTS 2,989,267 A * 6/1961 Mehl ..... D06F 53/045 242/378
3,193,212 A * 7/1965 Lotta ..... B65H 75/38 242/379.2
4,470,558 A * 9/1984 Stamper ..... D06F 53/045 242/378

(Continued)

FOREIGN PATENT DOCUMENTS

CN 108411583 8/2018
JP 4741450 5/2011

(Continued)

OTHER PUBLICATIONS

International Search Report issued Feb. 22, 2021 in corresponding International Patent Application No. PCT/JP2020/048237.

(Continued)

*Primary Examiner* — Sang K Kim
(74) *Attorney, Agent, or Firm* — Wenderoth, Lind & Ponack, L.L.P.

(57) ABSTRACT

A laundry drying implement includes a casing; a hollow bearing portion protruding in the casing; a drum that is supported on the hollow bearing portion, and rotatable about the hollow bearing portion; a laundry rope that is wound around the drum, and can be unreeled from and reeled onto the drum as the drum rotates; and a rotary damper that is received in the hollow bearing portion, and applies rotational resistance to the drum in a rope-reeling direction.

4 Claims, 13 Drawing Sheets

(56) References Cited

U.S. PATENT DOCUMENTS

| | | | | |
|---|---|---|---|---|
| 4,684,076 | A * | 8/1987 | Stamper | D06F 53/045 242/379.2 |
| 2021/0395937 | A1 * | 12/2021 | Matsumoto | B65H 75/4434 |

FOREIGN PATENT DOCUMENTS

| | | |
|---|---|---|
| JP | 2012-205622 | 10/2012 |
| JP | 2020-110273 | 7/2020 |

OTHER PUBLICATIONS

International Preliminary Report on Patentability issued Jun. 13, 2023 in corresponding International Patent Application No. PCT/JP2020/048237.

* cited by examiner

LAUNDRY DRYING IMPLEMENT

TECHNICAL FIELD

The present invention relates to a laundry drying implement of the wall-hanging type.

BACKGROUND ART

Laundry drying implements are known which allow hanging laundry on a laundry rope stretched between opposed wall surfaces in, e.g., the indoors of a building.

As a conventional laundry drying implement, there is a laundry drying implement including, as in Japanese U.S. Pat. No. 4,741,450, a casing which has a pull-out port in its front surface, and which, with its back surface opposed to an indoor wall surface, can be attached to the wall; a bearing portion protruding in the casing such that the center axis of the bearing portion coincides with the front-to-back surface direction of the casing; a drum supported on the bearing portion, and rotatable about the bearing portion in the normal and reverse directions; and a laundry rope that is wound around the drum, and that can be unreeled and reeled as the drum rotates in the normal and reverse directions.

This laundry drying implement further includes a guide mechanism that is built into the casing, and that changes the unreeled direction of the laundry rope from the drum such that the laundry rope can be pulled out through the pull-out port of the casing in the front surface thereof. A tab-shaped engagement part is attached to the distal end of the laundry rope, and the laundry rope while pulled out is engageable with an indoor wall surface via the engagement part.

Also, in order that the laundry rope is automatically reeled onto the drum while not in use, a spring is built into the casing, and biases the drum in the reeling direction of the laundry rope.

However, if the rope-reeling speed is too fast, the end of the rope could move violently and hit people or indoor objects and this is dangerous, a rotary damper is integrally connected to the front surface of the drum so as to apply rotational resistance in the rope-reeling direction, thereby reducing the rope-reeling speed.

SUMMARY OF THE INVENTION

Problems to be Solved by the Invention

For the laundry drying implement of Japanese Patent No. 4741450, since the drum and the rotary damper are disposed in parallel with each other in the axial direction of the bearing portion, the laundry drying implement has a large depth dimension, i.e., a large dimension in the front-to-back surface direction. Therefore, even while not in use, the laundry drying implement protrudes from the wall surface so as to take up a lot of space.

It is therefore an object of the present invention to provide a laundry drying implement of the so-called wall-hanging type having, for compactness, a small depth dimension, i.e., a small dimension in the front-to-back surface direction.

Means for Solving the Problems

In order to achieve the above object, the present invention provides a laundry drying implement comprising: a casing having a pull-out port in a front surface of the casing, and attachable to one of two wall surfaces in indoors of a building with a back surface of the casing opposed to the one of the two wall surfaces; a hollow, cylindrical bearing portion protruding in the casing such that a center axis of the bearing portion coincides with a front-to-back-surface direction of the casing; a drum supported on the bearing portion, and rotatable about the bearing portion in normal and reverse directions; a laundry rope wound around the drum, and configured to be unreeled from and reeled onto the drum as the drum rotates in the normal and reverse directions; a guide mechanism configured to change an unreeled direction of the laundry rope from the drum such that the laundry rope can be pulled out through the pull-out port of the casing in the front surface thereof; an engagement part which is attached to a distal end of the laundry rope, and via which the laundry rope is engageable with the other of the two wall surfaces, with the laundry rope pulled out; a spring biasing the drum in a rope-reeling direction in which the laundry rope is reeled onto the drum; and a rotary damper received in the bearing portion, and configured such that when a braking shaft of the rotary damper rotates in unison with the drum, the rotary damper applies to the drum rotational resistance in the rope-reeling direction.

Since the rotary damper is built into a bearing portion supporting the drum, the laundry drying implement of the wall-hanging type of the present invention has a small depth dimension in the front-to-back-surface direction so as to be reduced in size compared to a conventional arrangement in which the rotary damper and the drum are arranged in parallel to each other in the axial direction of the bearing portion.

In the laundry drying implement of the present invention, it is preferable that the bearing portion is formed by cylindrically recessing the back surface of the casing toward an interior of the casing, and the rotary damper is fitted into the bearing portion from the back surface of the casing.

If the bearing portion of the laundry drying implement is constituted as a recess disposed in the outer surface of the casing, and the rotary damper is fitted in this recess, it is possible to attach and detach the rotary damper without disassembling the casing, and thus to facilitate maintenance inspection, replacement, etc. of the rotary damper.

In the laundry drying implement of the present invention, it is preferable that the spring comprises a flat spiral spring, the laundry drying implement further comprises a cylindrical spring case in which the flat spiral spring is stored, and which is configured to rotate in unison with the drum within the casing, and the spring case includes a boss portion coupled to the braking shaft of the rotary damper so as to axially pass through the bearing portion on a rotation center axis of the spring case.

By providing the laundry drying implement with a spring case in which the flat spiral spring for reeling the rope onto the drum is received, it is possible to prevent the flat spiral spring from interfering with another component, and thus to avoid, e.g., malfunction. By providing the spring case with the boss portion, and coupling the boss portion to the braking shaft of the rotary damper, it is possible to rotate the braking shaft and the drum in unison via the spring case with a simple structure.

It is preferable that the laundry drying implement of the present invention further comprises a gear configured to rotate in unison with the drum within the casing; and a locking piece movable, in a radial direction of the gear, between a locking position where the locking piece is engaged with the gear and an unlocking position where the locking piece is disengaged from the gear.

It is more preferable that the gear has teeth inclined such that distal ends of the teeth face the rope-reeling direction, and the laundry drying implement is configured such that when a distal end portion of the locking piece moves, toward the locking position, from the distal end of one of the teeth of the gear to a root of the one of the teeth while coming into contact with the gear, a force pulling and returning the laundry rope in the rope-reeling direction is generated at the drum.

If the laundry drying implement is provided with the locking piece, when using the laundry drying implement, by moving the locking piece to the locking position so as to lock the drum with the laundry rope stretched between wall surfaces, it is possible to prevent the laundry rope from being reeled onto the drum unintentionally by the force of the spring.

After use of the laundry drying implement, by moving the locking piece to the unlocking position, the drum is unlocked, so that the laundry rope is automatically reeled onto the drum by the force of the spring.

Also, if the teeth of the gear of the laundry drying implement are inclined as described above, as the locking piece is moved to the locking position, a rotational force is generated to slightly rotate the drum in the rope-reeling direction by less than the distances between the adjacent pairs of the teeth.

Since, due to this slight rotation of the drum, tension is applied to the laundry rope stretched between wall surfaces, looseness and deflection of the laundry rope are prevented.

Effects of the Invention

The laundry drying implement of the wall-hanging type according to the present invention has the above structure, and thus has a small depth dimension in the front-to-back-surface direction so as to be reduced in size.

BEST MODE FOR CARRYING OUT THE INVENTION

An embodiment of the present invention is described below with reference to the drawings.

FIGS. 1A to 4B illustrate a laundry drying implement 1 according to the embodiment that is attached to one of two wall surfaces W, e.g., in the indoors of a building, and that is used to dry laundry by, when using the laundry drying implement 1, stretching a laundry rope 41 for drying laundry between the two wall surfaces W, and, for example, hanging hangers H from the laundry rope 41. While not in use, the laundry rope 41 is received in a casing 10 so as not to become an obstacle.

Figure 3:
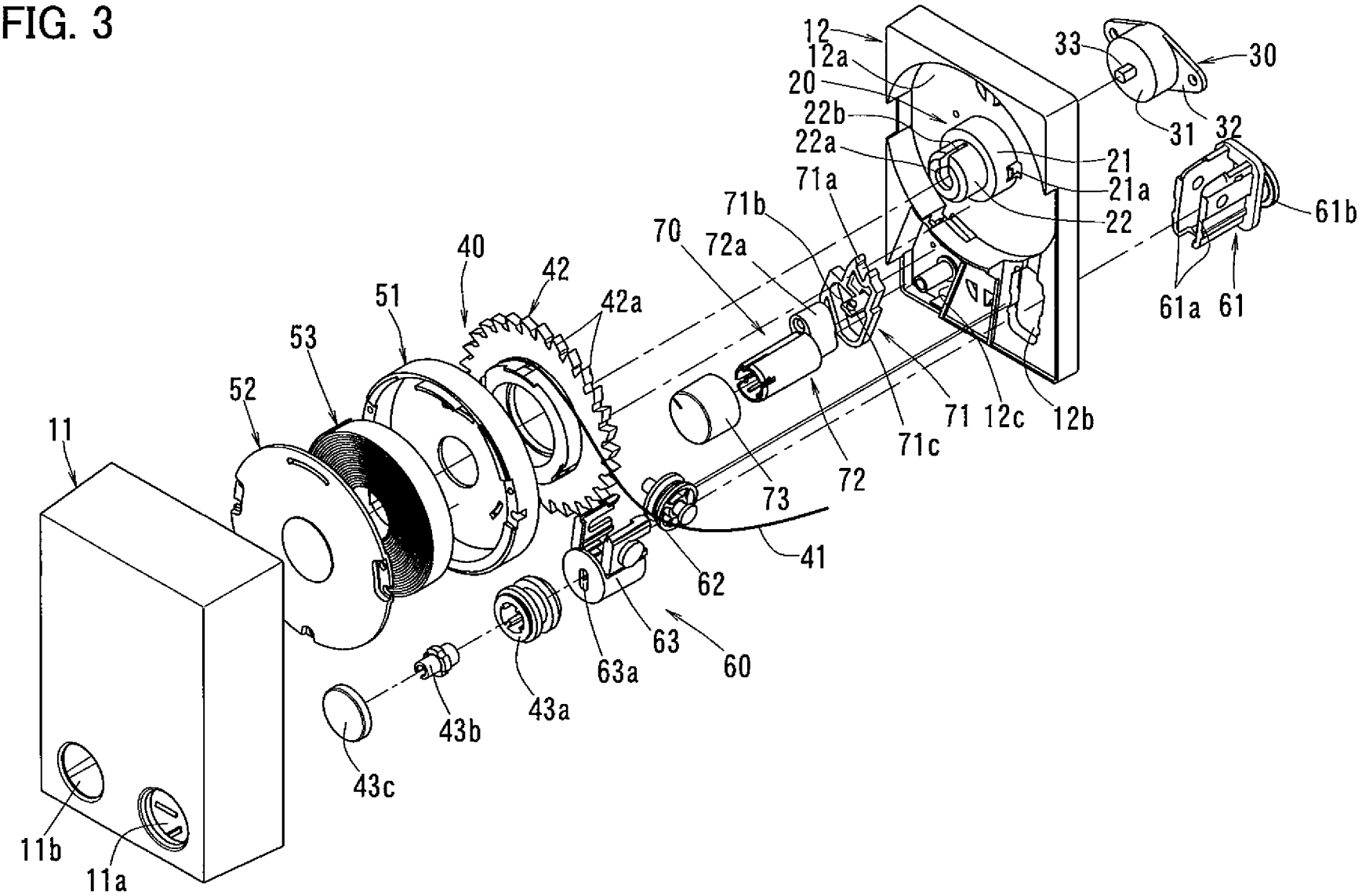
FIG. 3 is an exploded perspective view of the laundry drying implement.

As illustrated in FIG. 3, the laundry drying implement 1 of the embodiment includes the casing 10, and elements received in the casing 10 that are constituted by a bearing portion 20; a rotary damper 30; a drum 40 around which the laundry rope 41 is to be wound and which is provided with a gear 42; a spring case 50 in which a flat spiral spring 53 is received; a guide mechanism 60 for the laundry rope 41; and a locking mechanism 70 for the gear 42.

As illustrated in FIG. 3, the casing 10 comprises a cover 11 on its front side; and a base 12 on its back side that is covered with the cover 11. The cover 11 comprises a front panel, right and left side panels, and top and bottom end panels, and is open on its back side. The front panel has, in its lower portion, a pull-out port 11*a* and a dial hole 11*b* arranged in parallel to each other in the right-to-left direction.

As illustrated in FIG. 3, the base 12 has a flat cylindrical storage recess 12*a* in an upper portion of the base 12 on its front side, and includes, in a lower portion of the base 12 on its front side, a guide mechanism supporting portion 12*b* having an opening, and a locking mechanism supporting portion 12*c* provided with a rising shaft, the guide mechanism supporting portion 12*b* and the locking mechanism supporting portion 12*c* being arranged in parallel to each other in the right-to-left direction.

Figure 2:
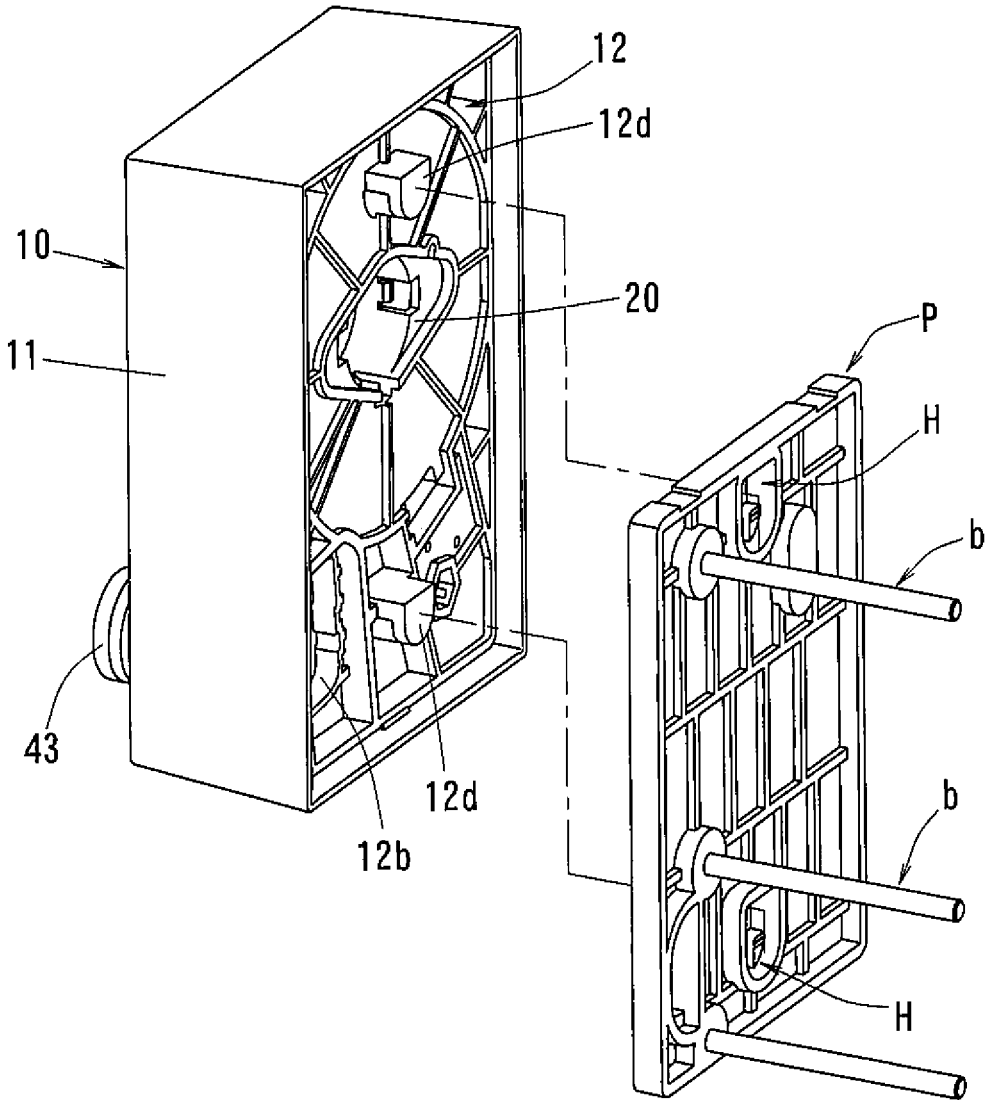
FIG. 2 is a perspective view of the laundry drying implement when seen from its back surface.

As illustrated in FIG. 2, hooks 12*d* are formed on upper and lower portions of the base 12 on its back side. By hooking the hooks 12*d* in respective hook holes H of a plate P fixed to the one wall surface W with truss screws b, it is possible to attach the casing 10 to the one wall surface W.

As illustrated in FIGS. 3 to 5B, the bearing portion 20 is integrally formed with the base 12 by being cylindrically recessed from the back surface of the base 12 toward the storage recess 12*a* on the front side.

The bearing portion 20 includes a large-diameter section 21 and a small-diameter section 22, and a step 23 is formed at the root of the large-diameter section 21. A guide claw 21*a* is formed on the outer periphery of the large-diameter section 21. An insertion port 22*a* is formed in the distal end of the small-diameter section 22, and a slit 22*b* is formed in the outer periphery of the small-diameter section 22.

As illustrated in FIGS. 3 to 5B, the rotary damper 30 is fitted into the bearing portion 20 from the back side of the base 12, and fixed in position using an appropriate means such as screws.

The rotary damper 30 includes a cylindrical damper body 31; flanges 32 extending from the damper body 31 to the right and left; and a braking shaft 33 extending from the center axis of the damper body 31. When the rotary damper 30 is fitted into the bearing portion 20, the flanges 32 are brought into abutment with the step 23, so that the rotary damper 30 is positioned.

A fluid such as oil is sealed in the damper body 31, and when the braking shaft 33 rotates, rotational resistance is applied by the viscous resistance of the fluid. As illustrated in FIG. 3, the protruding portion of the braking shaft 33 protruding from the damper body 31 has not a circular but an irregular cross section.

Figure 4A:
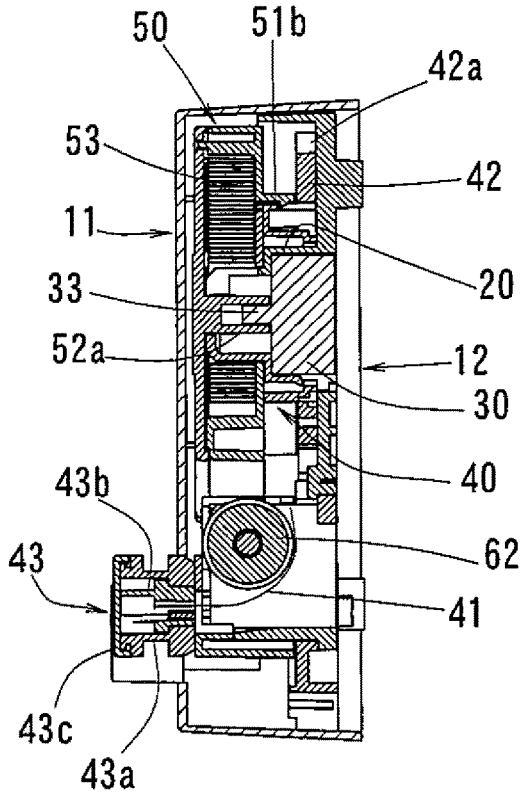
FIG. 4A is a sectional view taken along line A-A of FIG. 1A.
Figure 4B:
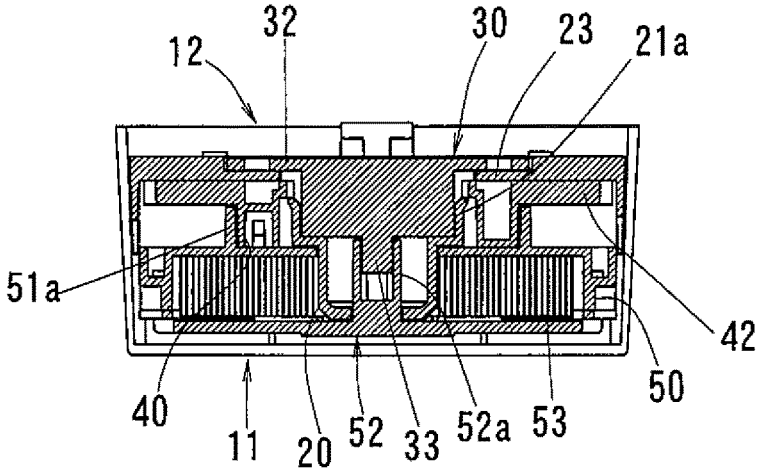
FIG. 4B is a sectional view taken along line B-B of FIG. 1A.

As illustrated in FIGS. 3, 4A and 4B, the cylindrical drum 40 is received in the storage recess 12*a* of the base 12, and supported on the large-diameter section 21 of the bearing portion 20 so as be rotatable about the large-diameter section 21. The guide claw 21*a* of the large-diameter section 21 is engaged with the inner periphery of the drum 40, and slides when the drum 40 rotates.

As illustrated in FIGS. 3 to 5B, the laundry rope 41, which is formed of, e.g., steel wire, is wound around the outer periphery of the drum 40 (and a drum coupling portion 51*a*, described later). The drum 40 has a large-diameter end constituting the gear 42, which has, on its outer periphery, teeth 42*a* arranged in a row.

As illustrated in FIGS. 8A to 10B, the teeth 42*a* of the gear 42 of the drum 40 are inclined such that the distal ends of the teeth 42*a* face the reeling direction of the laundry rope 41 onto the drum 40 (this direction is hereinafter referred to as the "rope-reeling direction" or "reeling direction").

One end of the laundry rope 41 is fixed to a fixing groove 44 of the drum 40 such that when the drum 40 rotates, the laundry rope 41 can be reeled onto the drum 40 or unreeled from the drum 40.

Figure 1A:
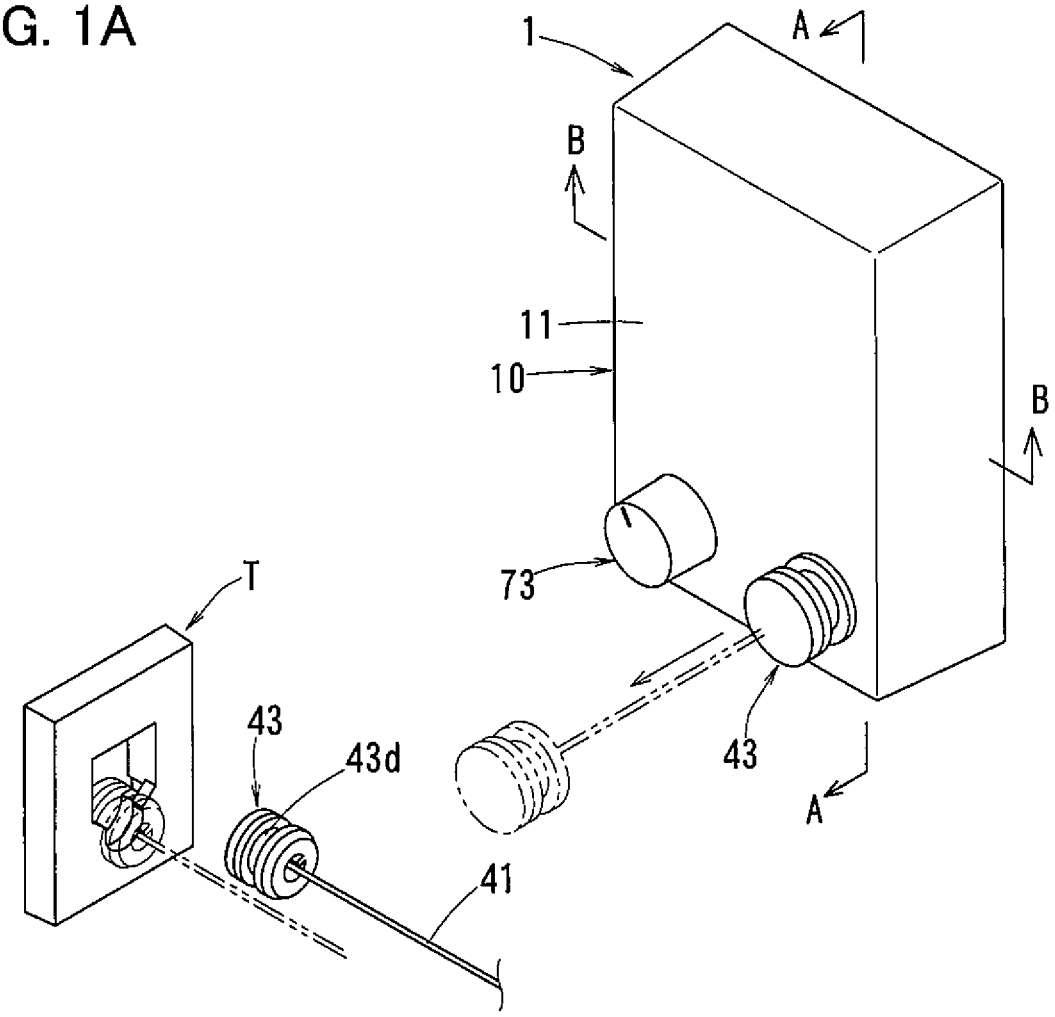
FIG. 1A is a perspective view of a laundry drying implement.
Figure 1B:
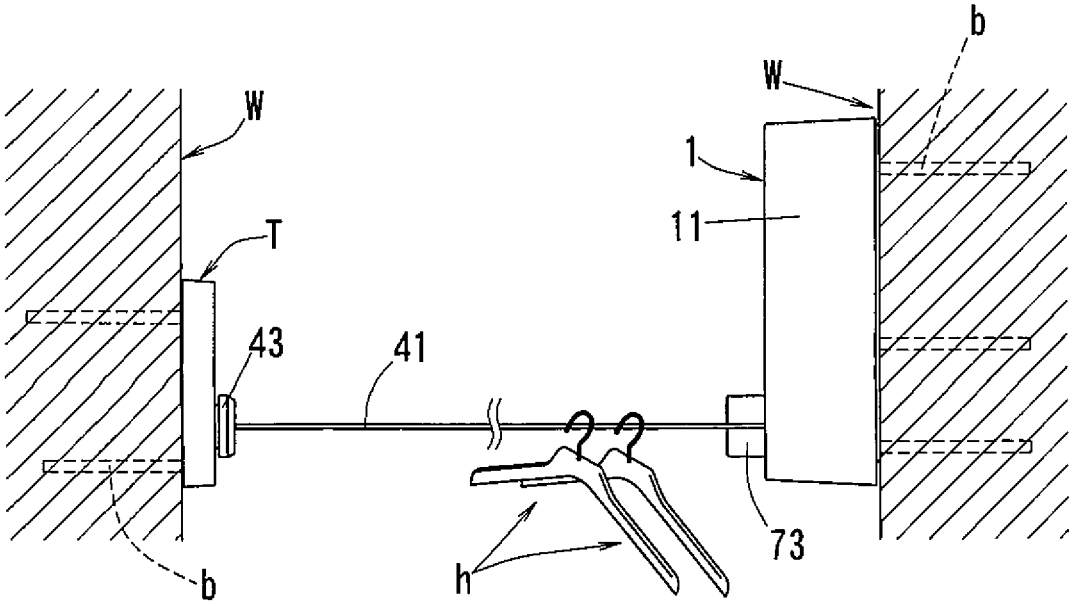
FIG. 1B is a side view illustrating the state in which the laundry drying implement is in use.

As illustrated in FIGS. 1A, 1B and 3 to 5B, a tab 43 as an engagement part is attached to the other end of the laundry rope 41. The tab 43 protrudes to the outside of the laundry drying implement 1 through the pull-out port 11*a* of the cover 11. When using the laundry drying implement 1, as illustrated in FIGS. 1A and 1B, a user can stretch the laundry rope 41 between the two wall surfaces W by pulling out the laundry rope 41 while grabbing the tab 43, and hooking the tab 43 to a tab stopper T fixed to the other wall surface W.

As illustrated in FIG. 3, the tab 43 comprises a cylindrical tab body 43*a*; a rope stopper 43*b* inserted in the tab body 43*a*; and a cap 43*c* closing an end surface of the tab body 43*a*.

The (other) end of the laundry rope 41 is fixed to the rope stopper 43*b*. The tab body 43*a* has, in its outer periphery, an engagement groove 43*d* at which the tab 43 is engageable with the tab stopper T.

As illustrated in FIGS. 3, 4A and 4B, the cylindrical spring case 50 is received in the storage recess 12*a* of the base 12 in parallel with the drum 40.

The spring case 50 is supported on the small-diameter section 22 of the bearing portion 20 so as to be rotatable about the small-diameter section 22 in unison with the drum 40.

Figure 5A:
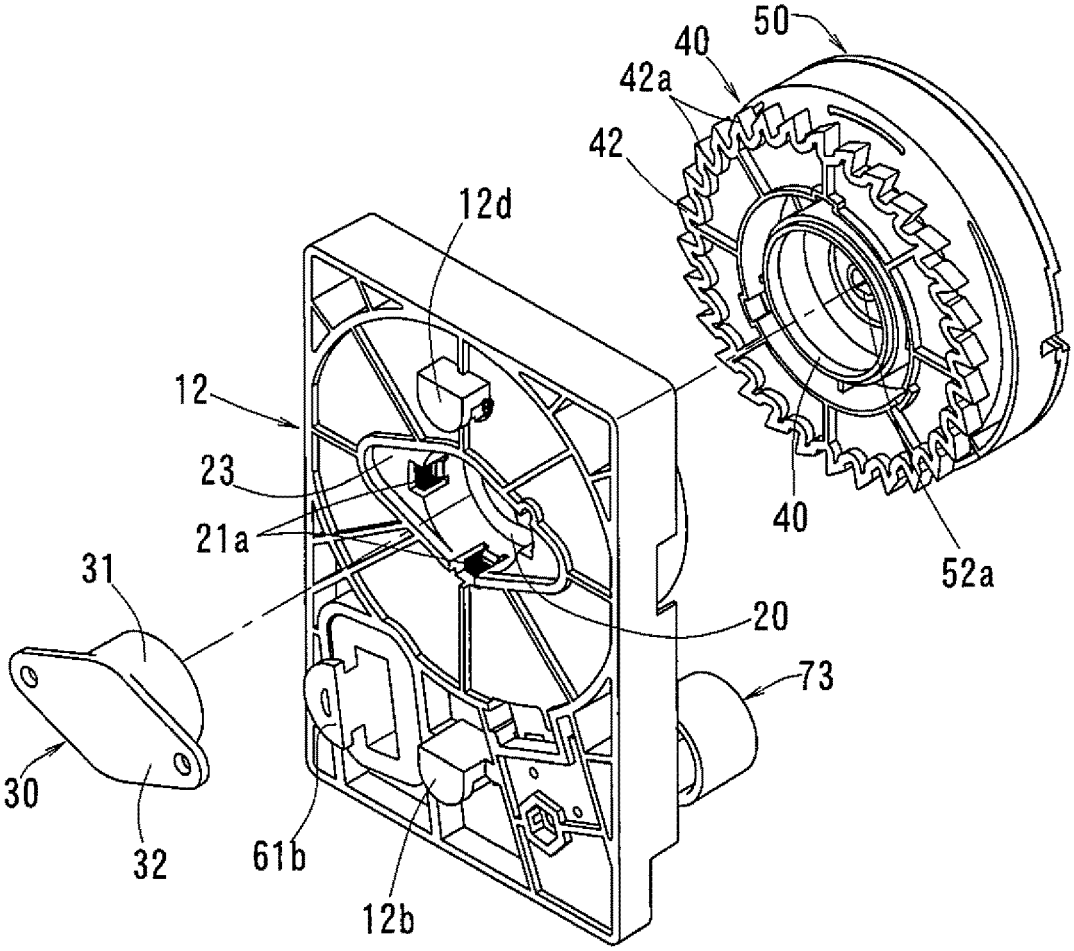
FIG. 5A is a perspective view illustrating how a rotary damper is attached.
Figure 5B:
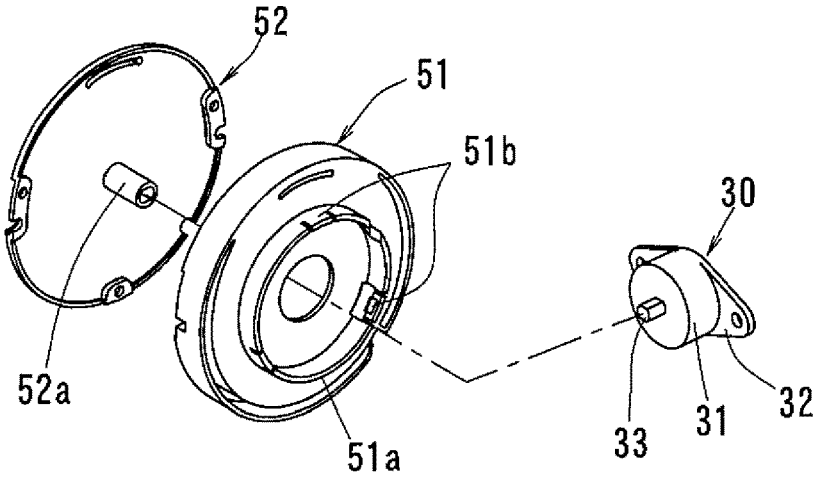
FIG. 5B is a perspective view illustrating how the rotary damper is attached.

The spring case 50 comprises a case body 51 and a lid 52, and the flat spiral spring 53 is received in the interior of the spring case 50. As illustrated in FIG. 5B, the case body 51 includes a cylindrical drum coupling portion 51*a* formed with circumferentially spaced apart coupling claws 51*b*. The drum coupling portion 51*a* is placed on the drum 40, and coupled to the drum 40 by engagement of the coupling claws 51*b*.

The flat spiral spring 53 has its inner end inserted into the slit 22*b* of the bearing portion 20, and folded to be fixed in position, and has its outer end fixed to the case body 51 by an appropriate means. When the drum 40 rotates in the unreeling direction of the laundry rope 41, an elastic force accumulates in the flat spiral spring 53 so that the rotational force in the rope-reeling direction is applied to the drum 40.

As illustrated in FIGS. 4A, 4B, 5A and 5B, a boss portion 52*a* is formed on the center of the lid 52 of the spring case 50, and a shaft hole having an irregular cross section is formed in the center of the boss portion 52*a*.

The boss portion 52*a* is inserted into the insertion port 22*a* of the distal end of the bearing portion 20, and fitted and coupled to the braking shaft 33 of the rotary damper 30.

Therefore, when the drum 40 rotates in unison with the spring case 50, the braking shaft 33 of the rotary damper 30 also rotates in unison, and rotational resistance is applied by the rotary damper 30.

Therefore, when the laundry rope 41 which has been pulled out of the casing 10 is being reeled onto the drum 40 by the rotation of the drum 40 due to the force of the flat spiral spring 53, the rotational speed of the drum 40 is reduced by the rotary damper 30.

As illustrated in FIGS. 3, 4A, 4B and 6, the guide mechanism 60 is attached to the guide mechanism supporting portion 12*b* of the base 12.

The guide mechanism 60 comprises a guide body 61, a spool 62 and a guide cover 63. The guide body 61 includes support plates 61*a* opposed to each other on the front side, and the spool 62 is rotatably supported between the support plates 61*a*. The guide body 61 includes, on the back side, an engagement piece 61*b* engaged with the opening edge of the guide mechanism supporting portion 12*b*.

The spool 62 is adjacent to the outer periphery of the drum 40, and has a rotation center axis extending substantially perpendicularly to the rotational center axis of the drum 40.

The guide cover 63 has a feeding port 63*a*, and covers the guide body 61. The feeding port 63*a* is opposed to the pull-out port 11*a* of the casing 10.

The laundry rope 41 is in contact with the spool 62, and inserted through the feeding port 63*a* of the guide cover 63.

Thus, since, between the drum 40 and the pull-out port 11*a* of the cover 11, the laundry rope 41 is passed via the guide mechanism 60, the direction in which the laundry rope 41 is fed from the drum 40 is changed, by the spool 62, to the direction coinciding with the pull-out port 11*a* of the cover 11, thus making it possible to pull out the laundry rope 41 easily through the pull-out port 11*a* of the casing 10.

Figure 6:
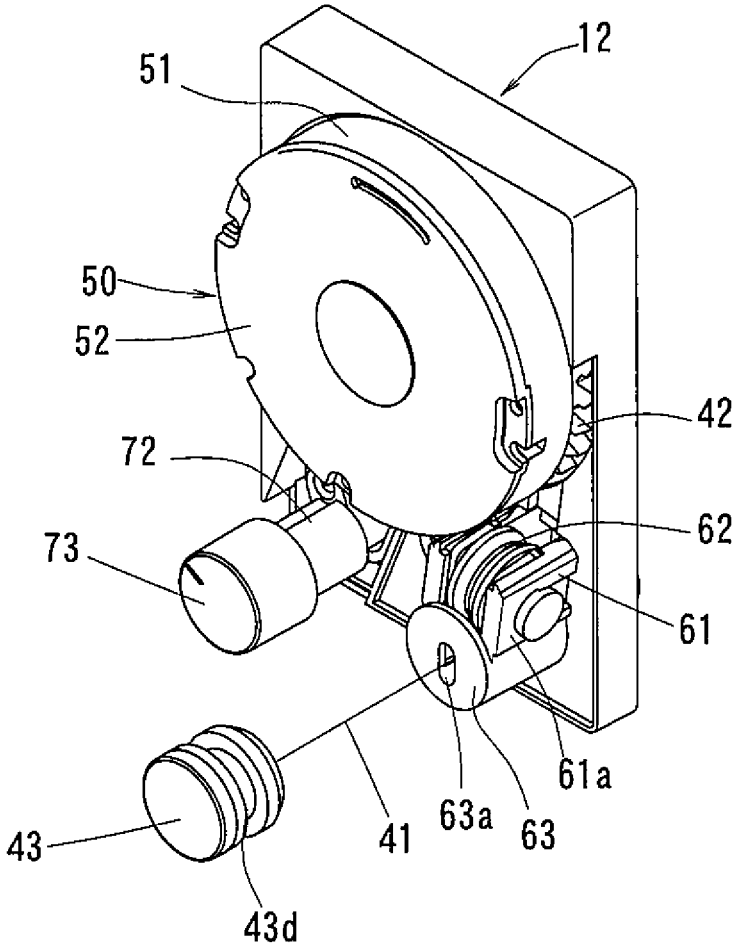
FIG. 6 is a perspective view of the laundry drying implement from which a cover has been removed.
Figure 7:
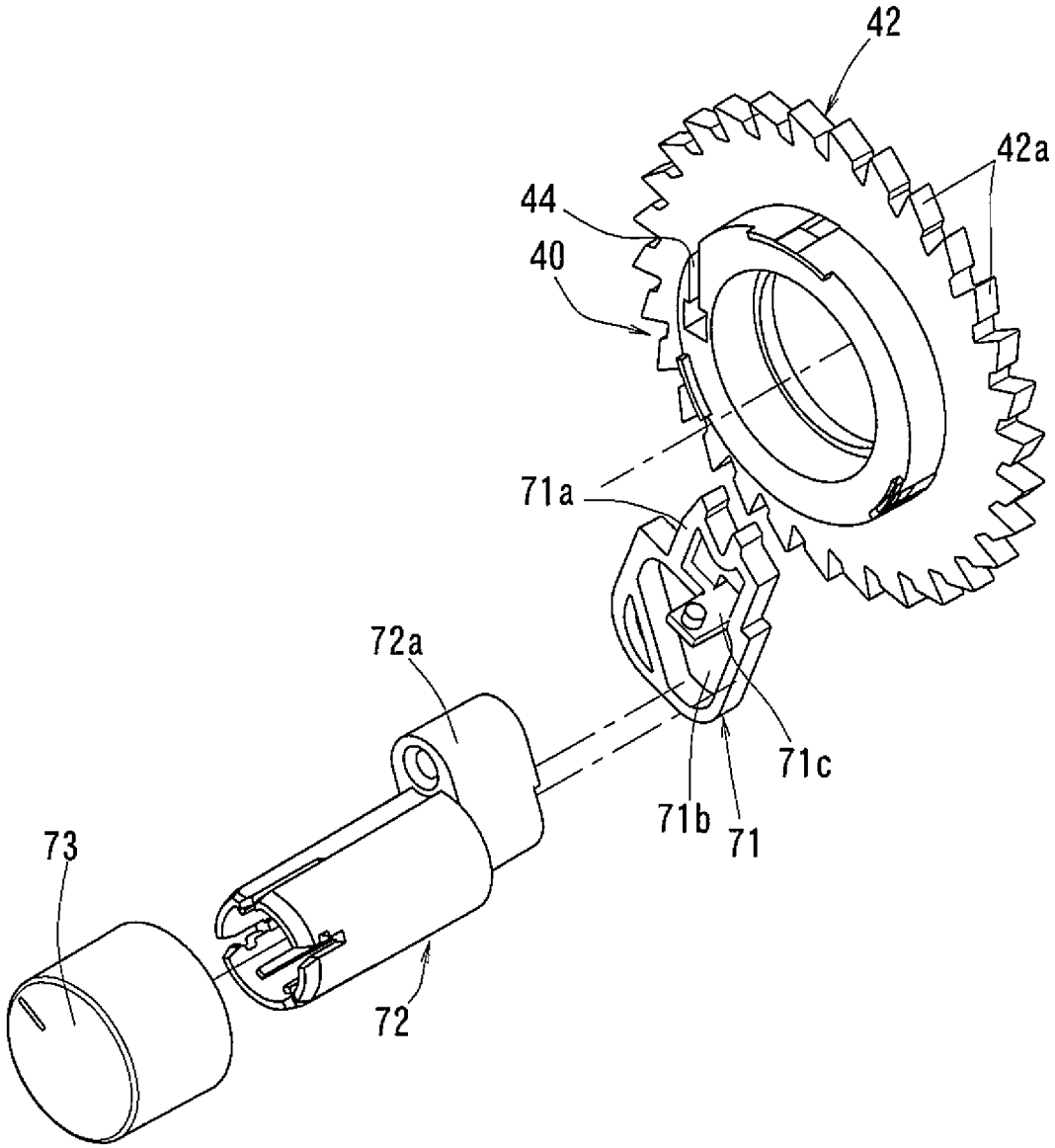
FIG. 7 is a perspective view illustrating engagement of a locking piece and a gear.

As illustrated in FIG. 3, the locking mechanism 70 is attached to the locking mechanism supporting portion 12*c* of the base 12. As illustrated in FIG. 6, the locking mechanism 70 comprises a plate-shaped locking piece 71, a conversion shaft 72 and a dial 73.

The plate-shaped locking piece 71 is fitted in the locking mechanism supporting portion 12*c* so as to be slidable in the directions toward and away from the gear 42.

The locking piece 71 has a distal end portion 71*a*71 which is complementary in shape to any tooth 42*a* of the gear 42, and thus can mesh with any tooth 42. The locking piece 71 is meshed with one of the teeth 42*a* at a locking position where the locking piece 71 is near the gear 42, and unmeshed (disengaged) from the one of the teeth 42*a* at an unlocking position where the locking piece 71 is away from the gear 42.

The locking piece 71 has a triangular window 71*b* extending through its side surfaces, and includes a spring piece 71*c* located between the distal end portion 71*a* and the widow 71*b*, and protruding beyond its side surface. The spring piece 71*c* is fixed to the base 12, and as the locking piece 71 approaches the gear 42, the amount of deflection and deformation of the spring piece 71*c* increases.

Therefore, due to the restoring elasticity of the spring piece 71*c*, the force toward the unlocking position is being applied to the lock piece 71 at all times.

The conversion shaft 72 is fitted to the rising shaft rising from the locking mechanism supporting portion 12*c*, and is rotatable about the rising shaft. One end of the conversion shaft 72 constitutes an elongated columnar cam portion 72*a* fitted in the window 71*b* of the locking piece 71.

The other end of the conversion shaft 72 is covered with the dial 73, and the dial 73 protrudes to the outside of the laundry drying implement 1 through the dial hole lib of the cover 11. By turning the dial 73, it is possible to rotate the conversion shaft 72.

When the conversion shaft 72 is rotated in one direction, the cam portion 72*a* pushes the edge of the window 71*b* of the locking piece 71, thereby causing the locking piece 71 to approach the gear 42 toward the locking position.

When the conversion shaft 72 is rotated in the other direction, the cam portion 72*a* is separated from the edge of the window 71*b* of the locking piece 71, and the pushing force is removed, as a result of which, the locking piece 71 is moved away from the gear 42 toward the unlocking position by the restoring force of the spring piece 71*c* of the locking piece 71.

Therefore, by turning the dial 73, which is coupled to the conversion shaft 72, it is possible to slide the locking piece 71 between the locking position and the unlocking position.

Figure 8A:
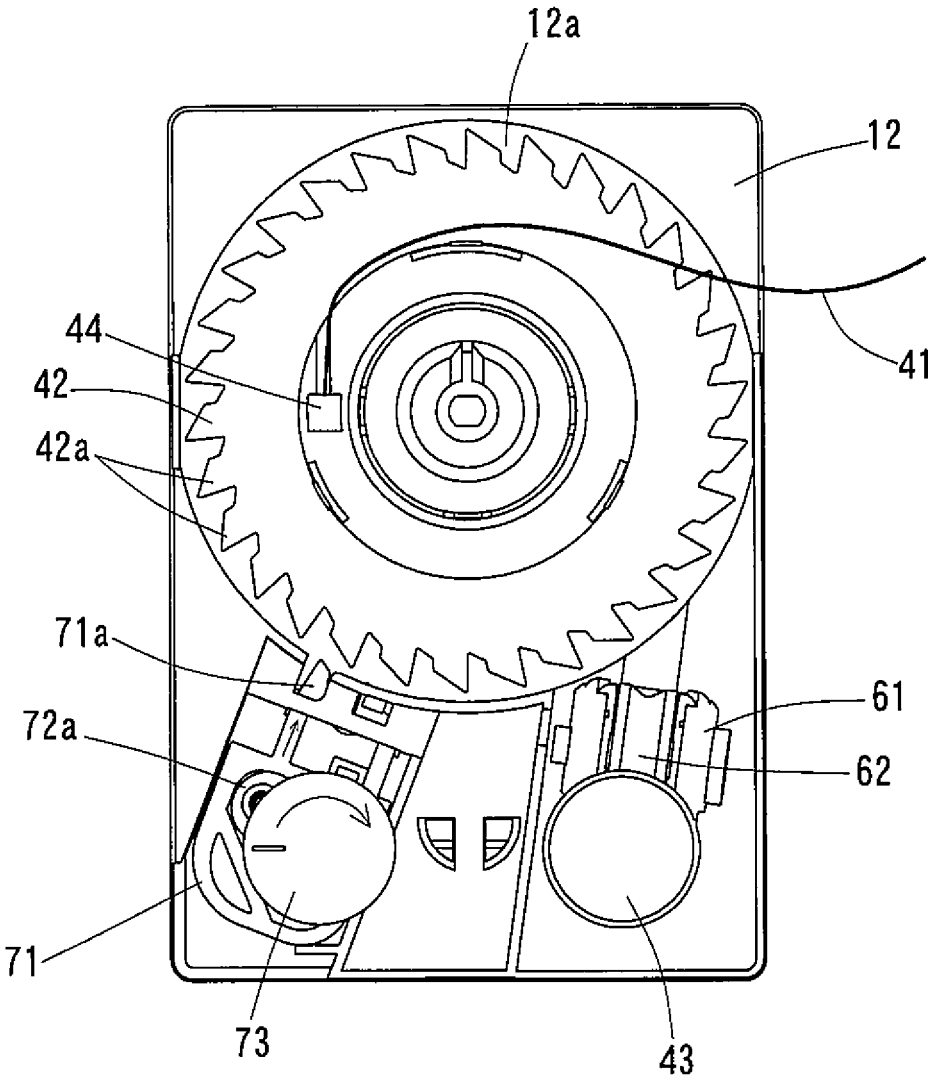
FIG. 8A is a plan view illustrating engagement of the locking piece and the gear.
Figure 8B:
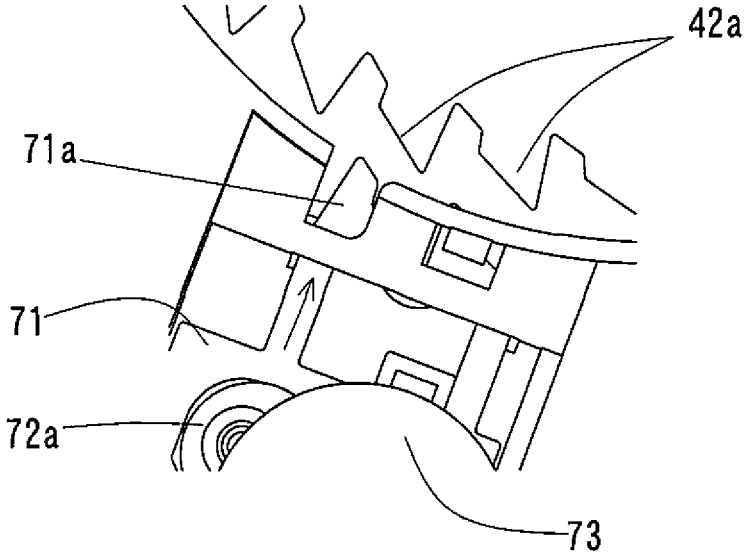
FIG. 8B is a plan view illustrating engagement of the locking piece and the gear.

Since, as illustrated in FIGS. 8A and 8B, when the locking piece 71 is at the unlocking position, the gear 42 is not locked, the drum 40 is rotatable, thus making it possible to freely adjust the length of the laundry rope 41 by which the laundry rope is pulled out.

If a user releases his/her hand from the laundry rope 41 with the rope 41 pulled out by a predetermined length, this will result in the drum 40 being rotated in the reeling direction by the action of the flat spiral spring 53, and the laundry rope 41 being automatically reeled onto the drum 40.

Figure 9A:
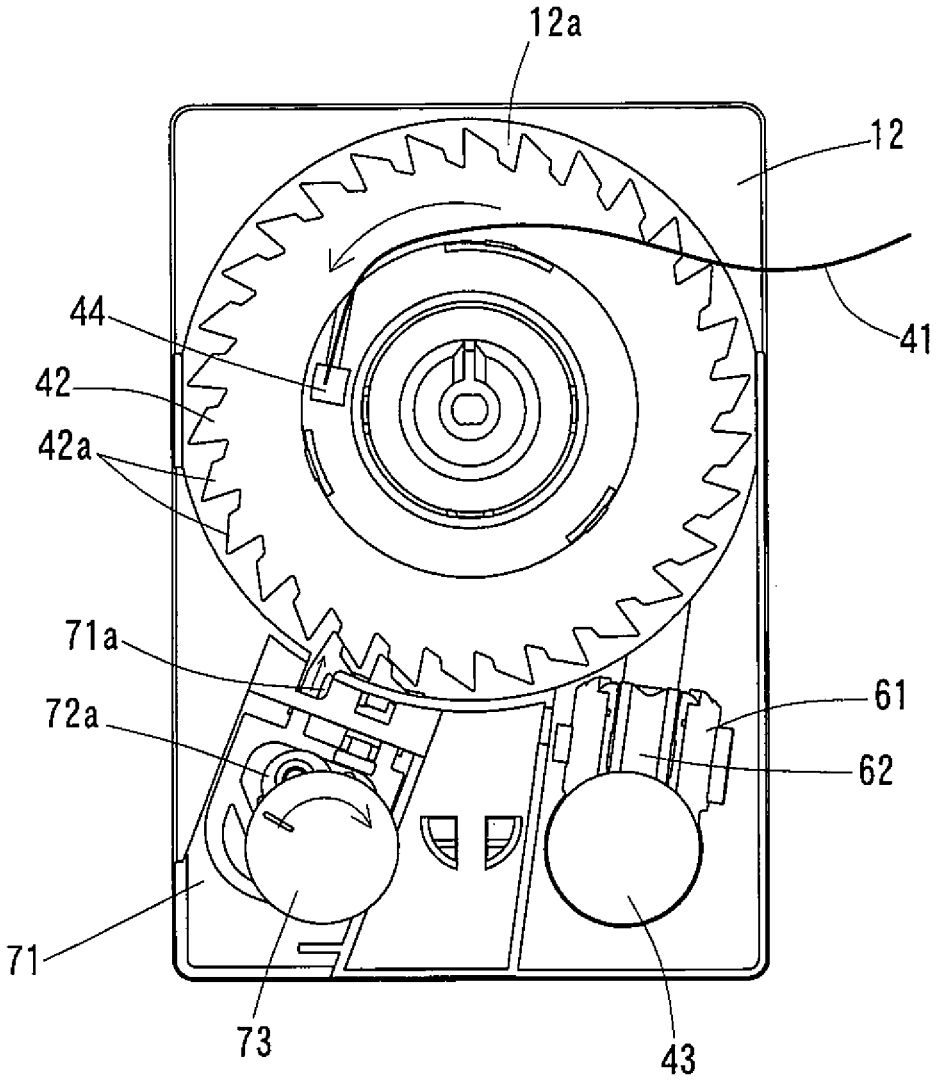
FIG. 9A is a plan view illustrating engagement of the locking piece and the gear.
Figure 9B:
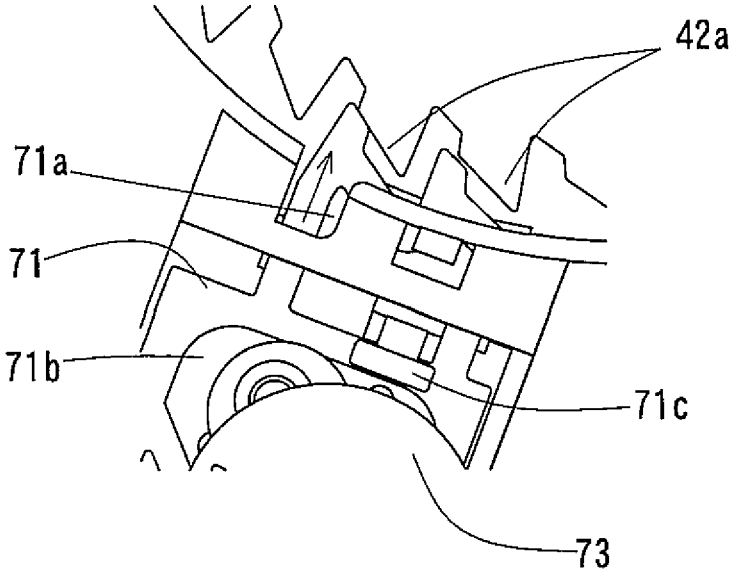
FIG. 9B is a plan view illustrating engagement of the locking piece and the gear.

In order to prevent this, the user can turn the dial 73, to slide the locking piece 71 to the locking position as illustrated in FIGS. 9A and 9B. When the locking piece 71 is at the locking position, its distal end portion 71*a* is meshed with one of the teeth 42*a* of the gear 42, and thus the gear 42 is locked. Therefore, the drum 40 is not rotatable, and thus the laundry rope 41 is fixable at the predetermined length.

Figure 10A:
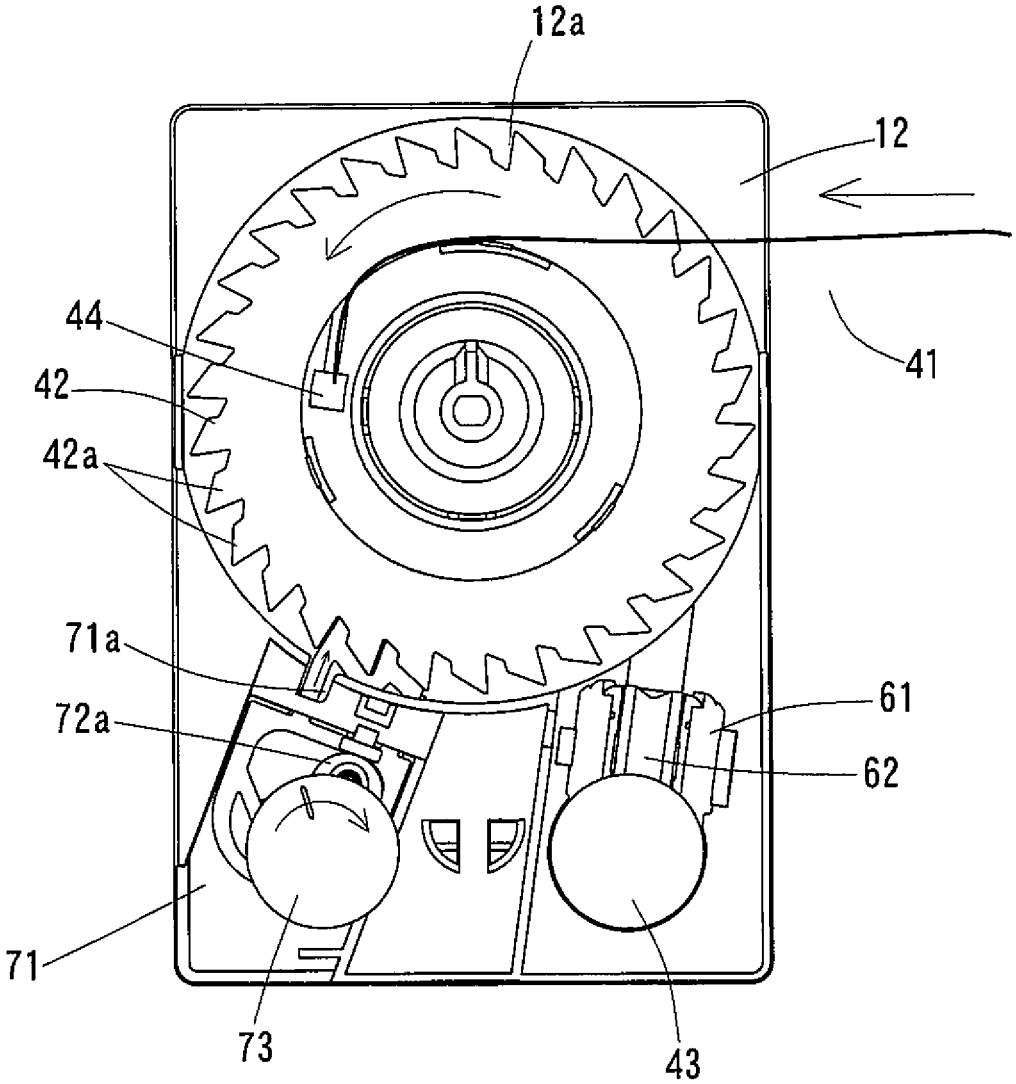
FIG. 10A is a plan view illustrating engagement of the locking piece and the gear.
Figure 10B:
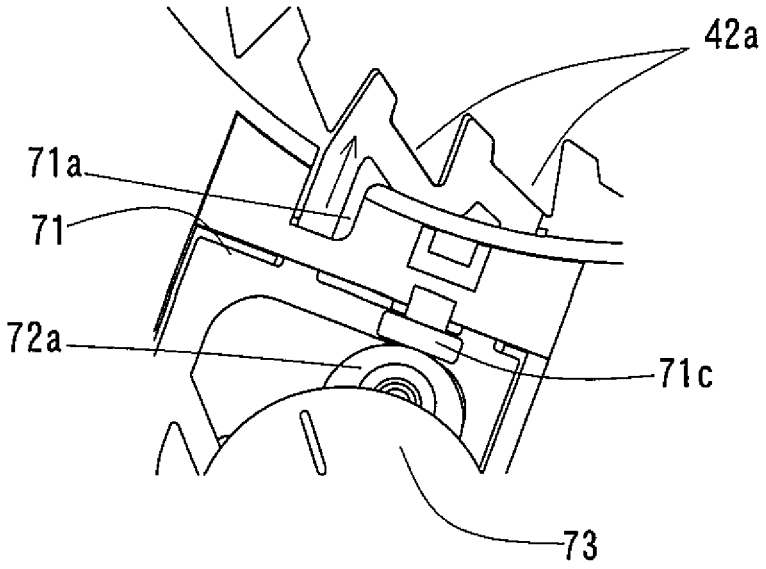
FIG. 10B is a plan view illustrating engagement of the locking piece and the gear.

If, as illustrated in FIGS. 9A and 9B, the laundry rope 41 is loose with the distal end portion 71*a* of the locking piece 71 meshed shallowly with one of the teeth 42*a* of the gear 42, the user can further turn the dial 73, thereby advancing the locking piece 71 as illustrated in FIGS. 10A and 10B.

As a result, since, as described above, the teeth 42*a* of the gear 42 are inclined such that the distal ends of the teeth face the rope-reeling direction, a pull-back force in the rope-reeling direction is generated at the gear 42 by the advancement of the locking piece 71, so that the gear 42 rotates slightly in the reeling direction as illustrated in FIGS. 9B to 10B. Therefore, as illustrated in FIGS. 10A and 10B, tension is applied to the laundry rope 41, thus making it possible to easily hang, e.g., laundry on the rope.

The above-described embodiment is a mere example in every respect, and the present invention is not limited thereto. The scope of the present invention is indicated by the claims, and includes all modifications and variations within the scope of the claims and the meaning equivalent to this.

DESCRIPTION OF REFERENCE NUMERALS

1: Laundry drying implement
10: Casing
11: Cover
11*a*: Pull-out port
11*b*: Dial hole
12: Base
12*a*: Storage recess
12*b*: Guide mechanism supporting portion
12*c*: Locking mechanism supporting portion
12*d*: Hook
20: Bearing portion
21: Large-diameter section
21*a*: Guide claw
22: Small-diameter section
22*a*: Insertion port
22*b*: Slit
23: Step
30: Rotary damper
31: Damper body
32: Flange
33: Braking shaft
40: Drum
41: laundry rope
42: Gear
42*a*: Tooth
43: Tab
43*a*: Tab body
43*b*: Rope stopper
43*c*: Cap
43*d*: Engagement groove
44: Fixing groove
50: Spring case
51: Case body
51*a*: Drum coupling portion
51*b*: Coupling claw
52: Lid
52*a*: Boss portion
53: Flat spiral spring
60: Guide mechanism
61: Guide body
61*a*: Support plate
61*b*: Engagement piece
62: Spool
63: Guide cover
63*a*: Feeding port
70: Locking mechanism
71: Locking piece
71*a*: Distal end portion
71*b*: Window
71*c*: Spring piece
72: Conversion shaft
72*a*: Cam portion
73: Dial
W: Wall surface
h: Hanger
P: Plate
b: Truss screw
H: Hook hole
T: Tab stopper

The invention claimed is:

1. A laundry drying implement comprising:

a casing having a pull-out port in a front surface of the casing, and being attachable to one of two wall surfaces in indoors of a building with a back surface of the casing opposed to the one of the two wall surfaces;

a hollow, cylindrical bearing portion protruding in the casing such that a center axis of the hollow, cylindrical bearing portion coincides with a front-to-back-surface direction of the casing;

a drum supported on the hollow, cylindrical bearing portion, and rotatable about the hollow, cylindrical bearing portion in normal and reverse directions;

a laundry rope wound around the drum, and configured to be unreeled from and reeled onto the drum as the drum rotates in the normal and reverse directions;

a guide mechanism configured to change an unreeled direction of the laundry rope from the drum such that the laundry rope can be pulled out through the pull-out port of the casing in the front surface of the casing;

an engagement part which is attached to a distal end of the laundry rope, and via which the laundry rope is engageable with the other of the two wall surfaces, with the laundry rope pulled out;

a flat spiral spring biasing the drum in a rope-reeling direction in which the laundry rope is reeled onto the drum;

a rotary damper received in the hollow, cylindrical bearing portion, and configured such that when a braking shaft of the rotary damper rotates in unison with the drum, the rotary damper applies rotational resistance to the drum in the rope-reeling direction; and a cylindrical spring case in which the flat spiral spring is stored, and which is configured to rotate in unison with the drum within the casing, wherein the cylindrical spring case includes a boss portion coupled to the braking shaft of the rotary damper so as to axially pass through the hollow, cylindrical bearing portion on a rotation center axis of the cylindrical spring case.

2. The laundry drying implement according to claim 1, wherein the hollow, cylindrical bearing portion is formed by cylindrically recessing the back surface of the casing toward an interior of the casing, and wherein the rotary damper is fitted into the hollow, cylindrical bearing portion from the back surface of the casing.

3. The laundry drying implement according to claim 2, further comprising:

a gear configured to rotate in unison with the drum within the casing; and a locking piece movable, in a radial direction of the gear, between a locking position where the locking piece is engaged with the gear and an unlocking position where the locking piece is disengaged from the gear, wherein the gear has teeth inclined such that distal ends of the teeth face the rope-reeling direction, and wherein the laundry drying implement is configured such that when a distal end portion of the locking piece moves, toward the locking position, from the distal end of one of the teeth of the gear to a root of the one of the teeth of the gear while coming into contact with the gear, a force pulling and returning the laundry rope in the rope-reeling direction is generated at the drum.

4. The laundry drying implement according to claim 1, further comprising:

a gear configured to rotate in unison with the drum within the casing; and a locking piece movable, in a radial direction of the gear, between a locking position where the locking piece is engaged with the gear and an unlocking position where the locking piece is disengaged from the gear, wherein the gear has teeth inclined such that distal ends of the teeth face the rope-reeling direction, and wherein the laundry drying implement is configured such that when a distal end portion of the locking piece moves, toward the locking position, from the distal end of one of the teeth of the gear to a root of the one of the teeth of the gear while coming into contact with the gear, a force pulling and returning the laundry rope in the rope-reeling direction is generated at the drum.

* * * * *